US008908898B2

(12) United States Patent
Im et al.

(10) Patent No.: US 8,908,898 B2
(45) Date of Patent: Dec. 9, 2014

(54) EARPHONE EASILY FACILITATING THE TYING AND UNTYING OF AN EARPHONE WIRE

(71) Applicants: Sung Sik Im, Seoul (KR); Jong Soon Im, Seoul (KR)

(72) Inventors: Sung Sik Im, Seoul (KR); Jong Soon Im, Seoul (KR)

( * ) Notice: Subject to any disclaimer, the term of this patent is extended or adjusted under 35 U.S.C. 154(b) by 0 days.

(21) Appl. No.: 13/958,189

(22) Filed: Aug. 2, 2013

(65) Prior Publication Data

US 2014/0140568 A1 May 22, 2014

(30) Foreign Application Priority Data

Nov. 21, 2012 (KR) ..... 10-2012-0132519
Feb. 4, 2013 (KR) ..... 10-2013-0012434
Feb. 21, 2013 (KR) ..... 10-2013-0018461

(51) Int. Cl.
*H04R 1/10* (2006.01)

(52) U.S. Cl.
CPC ..... *H04R 1/1033* (2013.01)
USPC ..... 381/384; 381/370; 439/501; 206/702; 174/70

(58) Field of Classification Search
CPC ..... H04R 1/1033; H04R 1/10; H01B 7/40; H01B 7/06; H01B 7/065; F16G 11/00–11/03
USPC ..... 381/384, 182, 370; 174/135, 70, 74; 439/501; 206/702
See application file for complete search history.

(56) References Cited

U.S. PATENT DOCUMENTS

| | | | | |
|---|---|---|---|---|
| 5,515,580 | A * | 5/1996 | McHenry, Jr. | 24/16 PB |
| 5,577,932 | A * | 11/1996 | Palmer | 439/501 |
| 7,238,889 | B2 * | 7/2007 | Rivera | 174/135 |
| 8,121,304 | B2 * | 2/2012 | Bales et al. | 381/74 |
| 2007/0034400 | A1 * | 2/2007 | Rivera | 174/138 G |
| 2010/0104126 | A1 * | 4/2010 | Greene | 381/384 |
| 2011/0170733 | A1 * | 7/2011 | Aase et al. | 381/384 |
| 2012/0121120 | A1 * | 5/2012 | Gorzelany | 381/384 |
| 2012/0230533 | A1 * | 9/2012 | Dallas | 381/384 |
| 2012/0241195 | A1 * | 9/2012 | Doll | 174/135 |
| 2012/0305288 | A1 * | 12/2012 | Scifo et al. | 174/135 |
| 2013/0039525 | A1 * | 2/2013 | Pang et al. | 381/384 |
| 2013/0048341 | A1 * | 2/2013 | Walder et al. | 174/135 |
| 2013/0202146 | A1 * | 8/2013 | Xue | 381/384 |
| 2013/0301864 | A1 * | 11/2013 | Glaser | 381/380 |
| 2013/0319760 | A1 * | 12/2013 | Wang | 174/74 R |
| 2014/0010400 | A1 * | 1/2014 | Morris | 381/384 |

FOREIGN PATENT DOCUMENTS

| | | | |
|---|---|---|---|
| KR | 10-2001-0111351 | A | 12/2001 |
| KR | 20-0397054 | Y1 | 9/2005 |
| KR | 10-2006-0024546 | A | 3/2006 |
| KR | 20-0462710 | Y1 | 9/2012 |

* cited by examiner

*Primary Examiner* — Curtis Kuntz
*Assistant Examiner* — Joshua A Kaufman
(74) *Attorney, Agent, or Firm* — Rabin & Berdo, P.C.

(57) ABSTRACT

An earphone facilitating the tying and untying of an earphone wire comprises a speaker portion worn in both ears, a branch line portion having one side connected to the speaker portion, a joint part in which at least two branch lines are joined, a single line portion having one side connected to the joint part, a connection portion disposed at the other side of the single line portion to be connected to a terminal of a sound system, and a tying portion with which ties a folded earphone wire and having an elastic helical coil spring shape and a hollow tube shape. The tying portion also surrounds a part of outer surface of the single line portion and is capable of sliding along the single line portion.

3 Claims, 21 Drawing Sheets

8/19

EARPHONE EASILY FACILITATING THE TYING AND UNTYING OF AN EARPHONE WIRE

BACKGROUND OF THE INVENTION

1. Field of the Invention

The present invention relates to an earphone and an earphone wire equipped with a tying portion that prevents the earphone wire from becoming entangled with itself. The tying portion is easily wound around the rest of the earphone wire which is longitudinally folded when the earphone is not in use, resulting in a tidy and compact shape. The configuration of the tying portion of the wire can be also applied to power cords, USB wires, transmission wires and other device wires to share the benefits of the present invention.

2. Description of the Related Art

In comparison with a headphone, an earphone known as an earbud has been commonly used to listen to music or auditory information with MP3 players, CD players or mobile phones in public places such as public transportation and public building, without disturbing others due to its fitness in the user's ear.

FIG. 1 illustrates a conventional earphone comprising: a speaker portion (11) worn in both ears; a branch line portion (12) wherein one side thereof is connected to the speaker portion (11); a single line portion (14) wherein one side thereof is connected to a joint portion wherein the two strands of the branch line portion (12) are collected; and a connection portion (15) disposed at the other end of the single line portion (14) to be connected to a terminal of a sound system.

A joint portion wherein the branch line portion (12) and the single line portion (14) are connected can include a stopper (13) which prevents the branch line portion (12) from being further split. The stopper (13) can be constructed using a hollow tube into which the single line portion (14) is inserted.

In addition, the speaker portion (11) can be secured on the user's exterior acoustic meatus by means of a mounting hook.

A conventional earphone often tends to fall out of the ear and causes discomfort since a long earphone wire is likely to be stuck with the user's arms or other objects while using.

When the earphone is not in use, most of the user usually wind the earphone wire around a portable electronic device or leave an earphone in the bag without organizing an earphone wire, in either case, an earphone wire easily gets entangled and causes discomfort.

Taking such problems into consideration, prior arts in the field introduces a variety of earphone wire organizer.

Referring to FIGS. 2(*a*) and (*b*), a wire rolling portion (400) installed with a torsion spring is equipped in the middle of an earphone wire (10) in order to wind an earphone wire (10) and prevent an earphone wire from being entangled with itself. However, using the wire rolling portion (400) with the torsion spring makes the earphone assembly complicate and bulky.

In the same way, FIG. 2(*c*) refers to an earphone with a wire roller (500) which rolls up an earphone wire. However, it is inconvenient for a user to carry the wire roller when using the earphone, and the bulky structure of the earphone assembly is also a common problem.

Korea Utility Model No. KR20-0462710Y1 describes an earphone with a case storing an extensible wire which is in the form of a helical coil spring like telephone wire as illustrated in FIG. 3. However, the earphone has two limitations; having a relatively long length even when compressed and needing an additional case to hold the coiled wire. Both limitations make the earphone bulky and inconvenient in daily use.

Referring to FIG. 4, Korea Laid-Open Pat. Publication No. KR10-2001-0111351A describes an earphone with a winder facilitating wind and unwind the first earphone wire, and the second earphone wire formed into a helical coil spring. The winder needs an additional case to roll up the first wire and the second wire is extensible. The earphone assembly with the first and second wire is too bulk to be portable for the user.

Korea Utility Model No. KR20-0397054Y1 describes an earphone wire connector (40) as shown in FIG. 19. The earphone wire connector (40) which is made of thermoplastic polymer by molding, comprises a body (41) and a pair of tension rib (43, 44). An earphone wire freely moves through the opening (42) of the body (41).

A pair of tension rib (43,44) is protruded from the side of the body (41) and spaced from each other. An earphone wire is forcibly inserted into a gap having the smaller width compared to the diameter of the earphone wire, between a pair of tension rib (43,44) wherein an inner space (46) therebetween conforms to the outer shape of the earphone wire.

However, it is inconvenient for a user to use the tension rib structure for the earphone assembly since it requires excessive force to insert or release the wire through the opening (42), and only one strand of the wire is allowed to be secured by a pair of tension rib (43,44).

THE RELATED PATENT (Patent No. 1) Korea Laid-Open Patent Publication No. KR10-2006-0024546A (2006 Mar. 17)

(Patent No. 2) Korea Laid-Open Patent Publication No. KR10-2001-0111351A (2001 Dec. 17.)

(Patent No. 3) Korea Utility Model No. KR20-0462710Y1 (2012 Aug. 26.)

(Patent No. 4) Korea Patent No. KR10-0397054Y1 (2005 Aug. 21.)

SUMMARY OF THE INVENTION

The problems with the prior arts in the field can be solved by the present invention which comprises an earphone that easily facilitates the tying and untying of an earphone wire. The earphone, according to the present invention comprises a tying portion on one side of a single line portion, wherein the tying portion either is formed into an elastic helical coil shape capable of tying a longitudinally folded earphone wire by its restoring force, or made of a deformable plastic material which enables the tying portion to be wound around the longitudinally folded earphone wire in the form of a helical coil shape. Therefore, the earphone wire is quickly, compactly secured within the tying portion. In addition, the earphone wire can be quickly released by simply pulling one side of the tying portion to be extended, instead of unwinding the tying portion. Further, a tying attachment can be used for easy tying and untying of the earphone wire without increasing the volume of the earphone.

One aspect of the present invention is to provide an earphone having a speaker portion (11) worn in both ears; a branch line portion (12) wherein one side thereof is connected to the speaker portion (11); a single line portion (14) wherein one side thereof is connected to a joint part wherein the two strands of the branch line portion (12) are collected; a connection portion (15) disposed at the other end of the single line portion (14) to be connected to a terminal of a sound system; and a tying portion formed into an elastic helical coil shape on one side of the single line portion (14), wherein the tying portion (2) is made of an elastic polymer or metal or coated metal and integrated into the single line portion (14), or is made of an elastic metal wire or coated metal wire and bonded to one side of the single line portion (14);

wherein the tying portion (2) is capable of tying an earphone wire folded or wound in several strands by being forcibly unfolded by applying an external force, being placed to be wound around the folded or wound earphone wire, and then removing the external force at a time so that the folded earphone wire is tied by a restoring force of the tying portion (2) in a one-touch way or winding the tying portion (2) around the folded or wound earphone while the external force is gradually removed;

wherein the tying portion (2) is capable of immediately untying the folded or wound earphone wire by pulling one side thereof, instead of unwinding the tying portion (2) in the opposite coil direction.

Another aspect of the present invention is to provide an earphone easily facilitating the tying and untying of an earphone wire having a speaker portion (11) worn in both ears; a branch line portion (12) wherein one side thereof is connected to the speaker portion (11); a single line portion (14) wherein one side thereof is connected to a joint part wherein the two strands of the branch line portion (12) are collected; a connection portion (15) disposed at the other end of the single line portion (14) to be connected to a terminal of a sound system; and a tying portion (2) formed on one side of the single line portion (14);

wherein the tying portion (2) is made of a plastically deformable polymer or metal or coated metal, and integrated into the single line portion (14), or a plastically deformable metal wire or coated metal wire and bonded to one side of the single line (14), and thus is capable of being bent when being applied with an external force and maintains a bending state even if the external force is removed, wherein the tying portion (2) is capable of tying an earphone wire folded or wound in several strands by being forcibly extended by pulling one side thereof, and then being wound around the folded or wound earphone wire, and wherein the tying portion (2) is capable of untying the folded or wound earphone wire by forcibly rotating and unwinding the tying portion (2), or by pulling one side thereof such that the tying is released in a one-touch way.

Another aspect of the present invention is to provide an earphone easily facilitating the tying and untying of an earphone wire comprising the tying portion (2) formed into a hollow tube into which the single line portion (14) is inserted, capable of sliding up and down along the single line portion (14).

Another aspect of the present invention is to provide an earphone facilitating the tying and untying of an earphone wire comprising the tying portion (2) installed on one side of the single portion (14) and over the joint portion between the single line portion (14) and the connection portion (15).

Another aspect of the present invention is to provide an earphone easily facilitating the tying and untying of an earphone wire comprising the tying portion (2) having a length capable of being wound by 2~6 turns around the folded earphone wire.

Another aspect of the present invention is to provide an earphone easily facilitating the tying and untying of an earphone wire comprising the tying portion (2) wherein the single line portion (14) and the tying portion (2) positioned on one side of the single line portion (14) is combined by coating or molding on the outer side using a polymer in order for the tying portion (2) and the single line portion (14) to be integrated to each other.

Another aspect of the present invention is to provide an earphone easily facilitating the tying and untying of an earphone wire comprising the tying portion (2) with an indicator (21) constructed in the middle of the tying portion (2).

Another aspect of the present invention is to provide an earphone easily facilitating the tying and untying of an earphone wire having a reduced volume which provides portability and convenience to a user.

Another aspect of the present invention is to provide a wire comprising the above mentioned tying portions (2).

Another aspect of the present invention is to provide a wire installed with a tying attachment (7) comprising: a body part (71) embodied with a penetration hole through which the wire is inserted; and a fixing part (73) formed into a flat spiral spring and extensible from the body part (71).

BRIEF DESCRIPTION OF THE DRAWINGS

The above and other objects, features and other advantages of the present invention will be more clearly understood from the following detailed description taken in conjunction with the accompanying drawings, in which:

FIG. 9 illustrates a indicator of an earphone according to the second embodiment of the present invention;

Figure 1:
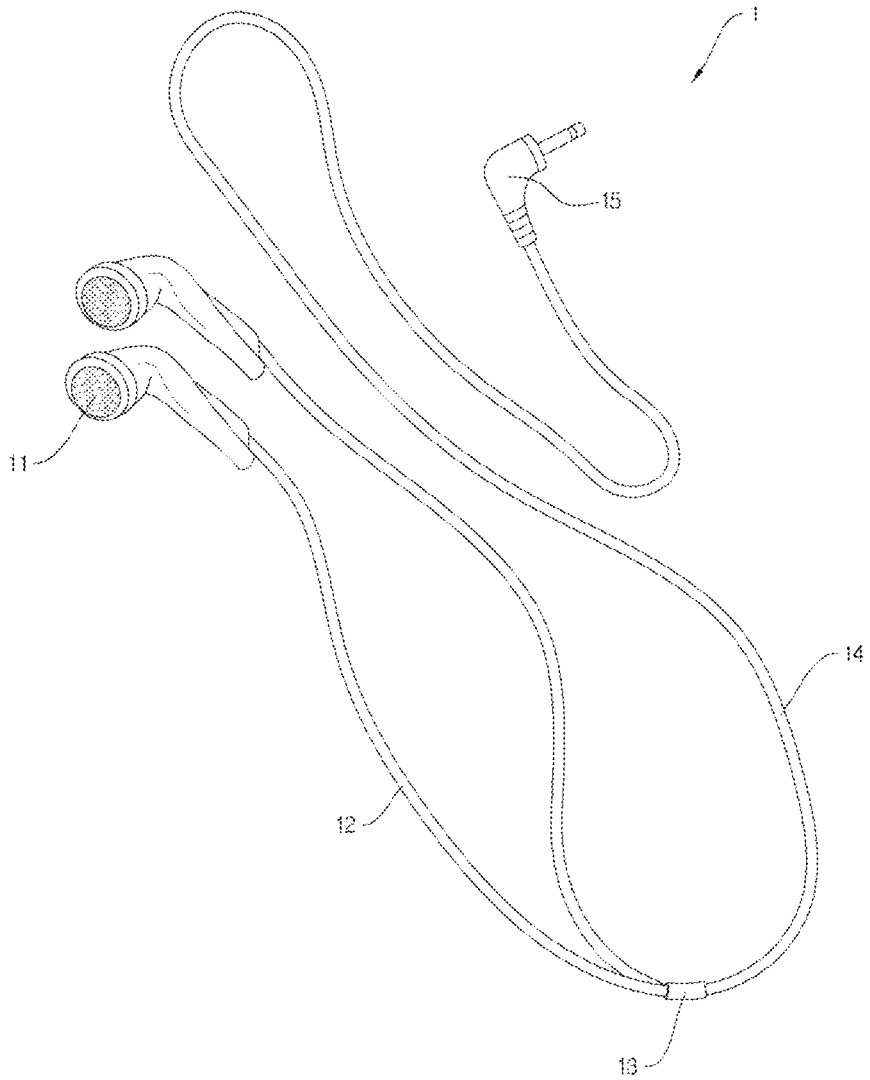
FIG. 1 PRIOR ART
FIG. 1 illustrates a conventional earphone.
Figure 2:
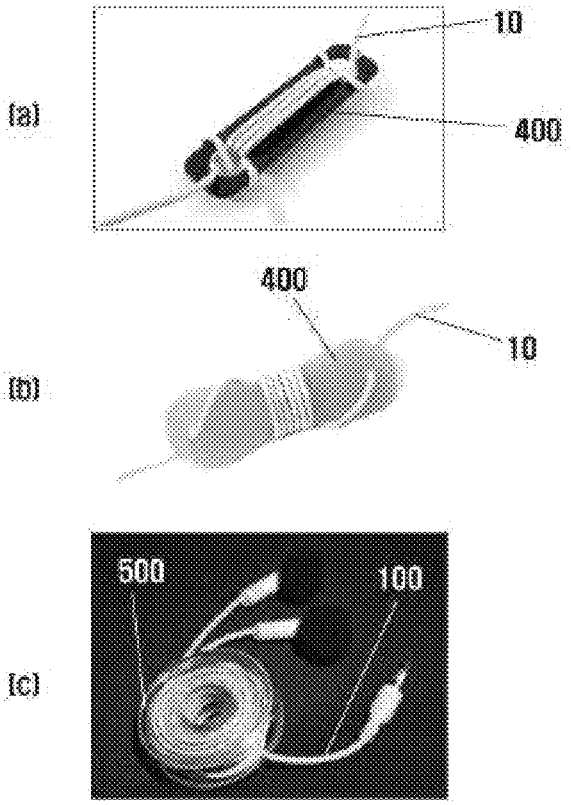
FIG.2 PRIOR ART
FIGS. 2-4 illustrate a prior art of an earphone wire organizer.
Figure 3:
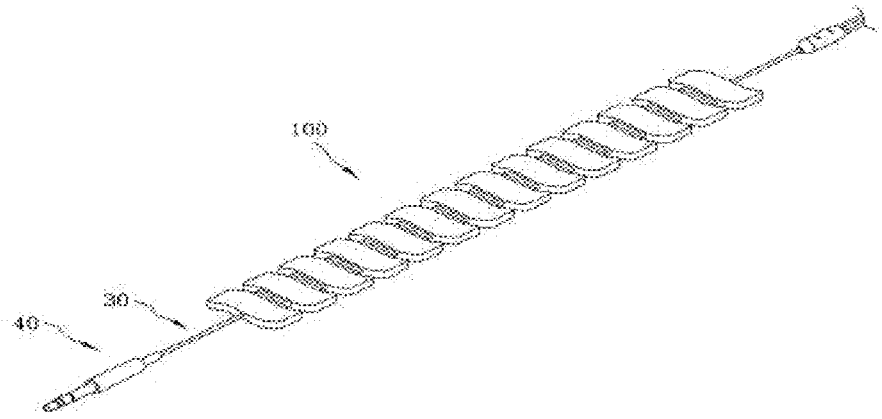
FIG. 3 PRIOR ART
Figure 4:
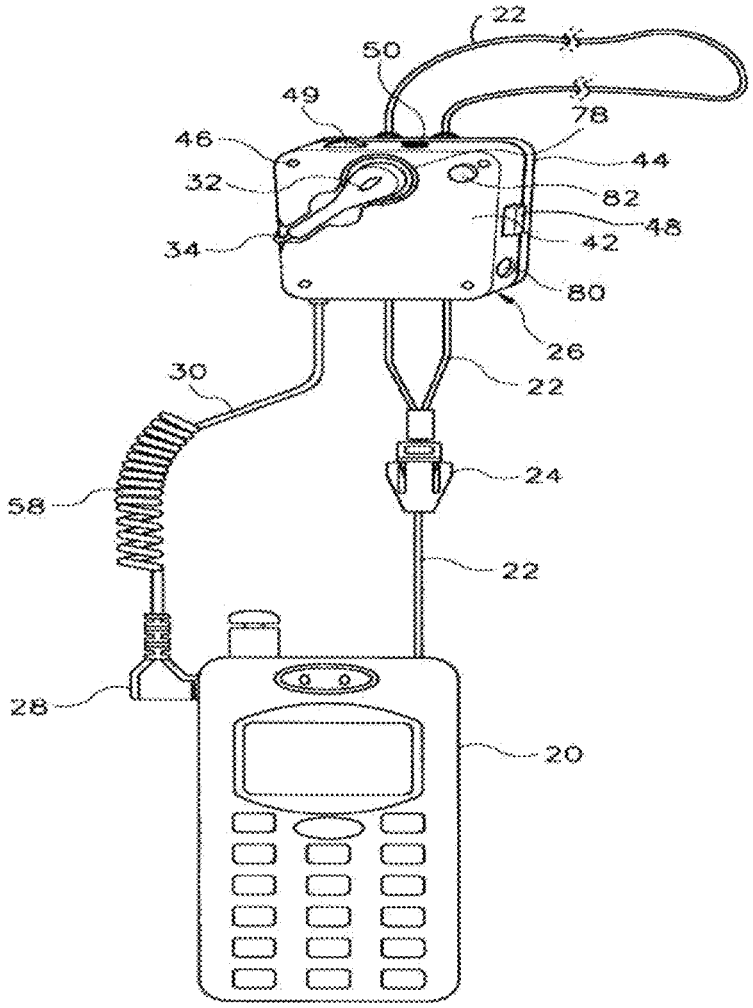
FIG.4 PRIOR ART

| [Description of important reference number] | |
|---|---|
| 1: earphone | 11: speaker portion |
| 12: branch line portion | 13: stopper |
| 14: single line portion | 15: connection portion |
| 2: tying portion | 21: indicator |
| 22: hole | 7: tying attachment |
| 71: body part | 73: fixing part |
| 731: bending portion | 114: wire |
| 113: bifurcation portion | 110: speaker portion |
| 150: connection portion | 100: earphone |

DETAILED DESCRIPTION OF THE PREFERRED EMBODIMENT

The present invention relates to an earphone facilitating the tying and untying of earphone wire with a tying portion formed on a single line portion for the easy organization of an earphone wire without an additional fixing attachment.

The present invention is characterized by having a tying portion which is formed into an elastic helical coil spring shape, or made of plastically deformable material and wound into a helical coil spring shape, in an earphone wire. The length of the helical coil shape of the tying portion is relatively short compared to the entire length of the earphone, and thus the tying and untying of the earphone wire can be completed easily and quickly.

A major role of the helical coil spring configuration of the tying portion is to tie the folded earphone wire, therefore the longitudinal stretching property of the tying portion is regarded as less important in the present invention. It is also understood that the excessive number of turns of the tying portion would make the tying and untying of the folded earphone wire less effective.

The earphone of the present invention may have the tying portion made of a plastically deformable material, i.e. a thin metal wire and thus capable of being bent when being applied with an external force and maintains a bending state even if the external force is removed. The tying portion is constructed in appropriate length over the joint portion of the single line portion and the connector portion so that the joint portion reinforced by the tying portion prevents the earphone wire from being damaged or cut by the frequent bending thereof.

The earphone of the present invention may comprise a tying portion in the form of a hollow tube capable of sliding along the single line portion such that the position of the tying portion can be adjusted around the middle of the folded earphone wire by pulling the single line portion located near the tying portion.

The elastic helical coil shape configuration of the tying portion is primarily designed for the tying of the earphone wire rather than the reducing of the length of the earphone wire. Therefore, the tying portion is provided in a section which is very short compared to the entire length of the earphone.

Reference will now be made in detail to the present preferred embodiments of the invention, examples of which are illustrated in the accompanying drawing. Wherever possible, the same reference numbers are used in the drawings and the description to refer to the same parts.

Reference to parts of the present invention will accompany with 「', ", or '"」 according to the preferred embodiment. For example, the tying portion (14) and (14'") is the tying portion of the first and the forth embodiment of the present invention, respectively. The meaning of "the folded wire" or "the folded or wound wire", or "the folded or wound earphone wire" is conveniently defined as the wire from a branch line portion to a part of the single line portion which is longitudinally folded or wound in several times, and will be wound by the tying portion.

It is understood that the well known technical features and functions of the present invention to a person skilled in the art will be omitted for the purpose of clarification of the present invention.

The First Embodiment of the Present Invention

The first embodiment of the present invention relates to an earphone having a speaker portion (11) worn in both ears; a branch line portion (12) wherein one side thereof is connected to the speaker portion (11); a single line portion (14) wherein one side thereof is connected to a joint part wherein the two strands of the branch line portion (12) are collected; a connection portion (15) disposed at the other end of the single line portion (14) to be connected to a terminal of a sound system, and a tying portion (2) formed into an elastic helical coil spring shape on the single line portion (14), wherein the tying portion (2) is made of an elastic polymer or metal or coated metal and integrated into the single line portion (14), or is made of an elastic metal wire or coated metal and bonded to one side of the single line portion (14);

wherein the tying portion (2) is capable of tying an earphone wire folded or wound in several strands by being forcibly unfolded by applying an external force, being placed to be wound around the folded or wound earphone wire, and then removing the external force at a time so that the folded earphone wire is tied by a restoring force of the tying portion (2) in a one-touch way or winding the tying portion (2) around the folded or wound earphone while the external force is gradually removed;

wherein the tying portion (2) is capable of immediately untying the folded or wound earphone wire by pulling one side thereof, instead of unwinding the tying portion (2) in the opposite coil direction.

Figure 5:
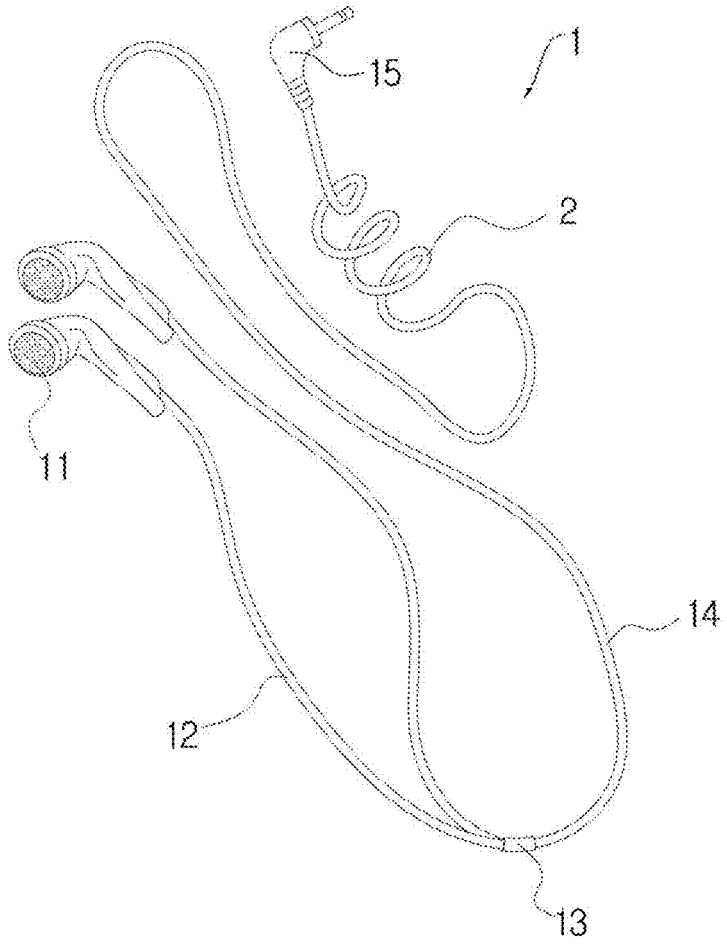
FIG. 5 illustrates the first embodiment of the present invention.
Figure 6:
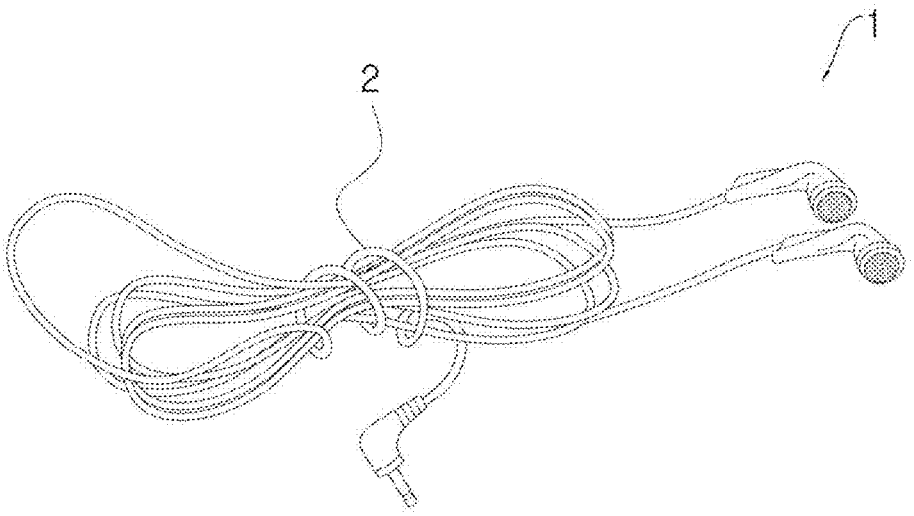
FIG. 6 illustrates an view of the folded earphone wire tied by a tying portion of the first embodiment of the present invention.

FIGS. 5 and 6 illustrate a view of the folded earphone wire before and after tied with the tying portion (2) in accordance with the first embodiment of the present invention, respectively.

The tying portion (2) is integrated into the single line portion (14) and preferably formed into a helical coil spring shape with multiple turns as shown in FIG. 5. However, the shape of the tying portion (2) is not to be limited by the illustrated embodiments.

In addition, the tying portion (2) can be provided in a section which is substantially short compared to the entire length of the earphone and be wound coilwise around the folded or wound earphone wire.

The tying portion (2) is constructed in either way that the tying portion (2) made of a metal wire is embedded with the single line portion (14) by coating and then formed into a helical coil spring shape, or a helical coil spring shape wire is bonded to the part of the single line portion (14), so that the tying portion (2) has compressive force, elasticity and tension for being longitudinally stretchable when the external force is applied. The tying portion (2) is capable of being easily wound coilwise around the folded wire after forcibly stretched. By removal of the force, the tying portion (2) tends to recover to the original shape so that the folded wire is tightly secured by the tying portion (2).

In details, when the earphone which normally has a length of roughly 110 cm is folded in several times to form approximately 13-15 strands of wire, the winding is enabled by rotating the tying portion which is positioned on one side of the single line portion, by 2-6 turns without additional knotting.

Referring to FIGS. 5-6, a tying process of the first embodiment of the present invention is as follows: The earphone wire from the speaker portion (11) to the tying portion (2) is longitudinally folded in several times; the tying portion (2) is forcibly unfolded by applying an external force; the tying portion (2) is placed to be wound around the folded or wound earphone wire, the external force exerted on the tying portion (2) is removed at a time; the folded earphone wire is tied by a restoring force of the tying portion (2) in a one-touch way. As an alternative way, the tying portion (2) is forcibly unfolded by applying an external force and is wound around the folded earphone while the external force is gradually removed.

In order for the unwinding of the tying portion (2), one end of the tying portion (2) is pulled at a time in a one-touch way, instead of unwinding the tying portion (2) in the opposite coil direction.

It would be obvious that if the tying portion (2), which is extended and unfolded in a straight line by applying an external force and a folded earphone wire are wound together closely to a right angle, the winding is close to one turn of the tying portion, and if the tying portion is wound in parallel to the folded earphone wire, all of the turns (e.g. six turns) of the tying portion are applied such that the winding is performed in a tighter manner.

FIGS. 7*a*-7*d* illustrate a process to integrate an elastic metal plate into a part of the single line portion (14) by bonding.

Figure 7A:
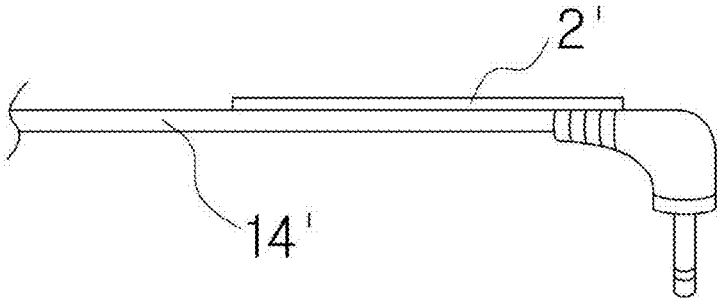
FIGS. 7*a*-7*e* illustrate schematic views of a coupling process of a single line portion and a tying portion of an earphone according to the second embodiment of the present invention.
Figure 7B:
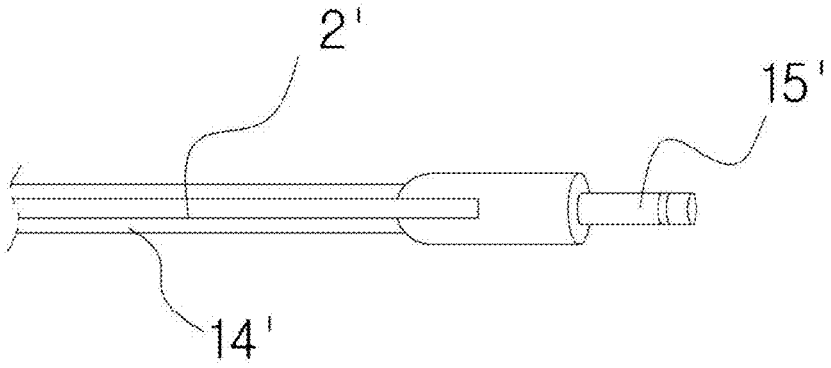
Figure 7C:
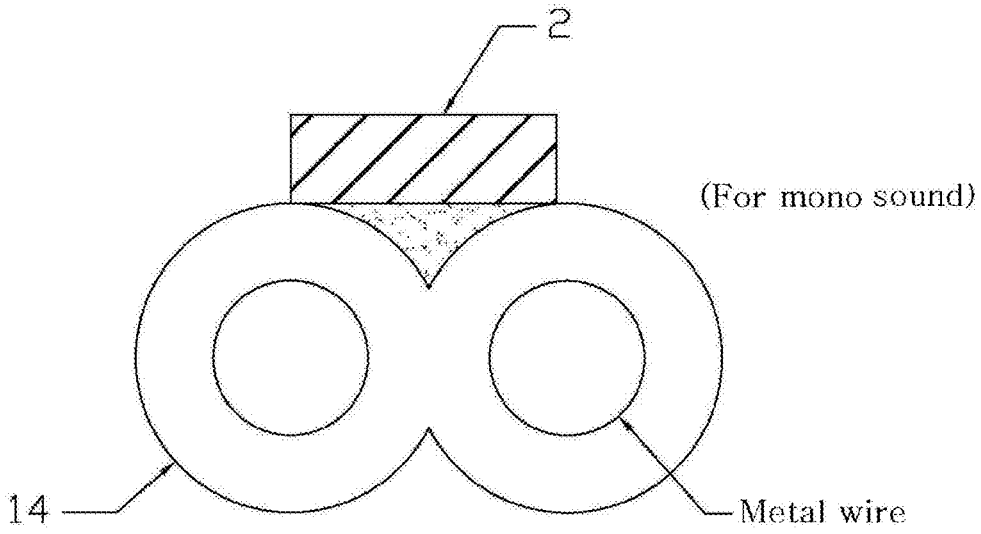
Figure 7D:
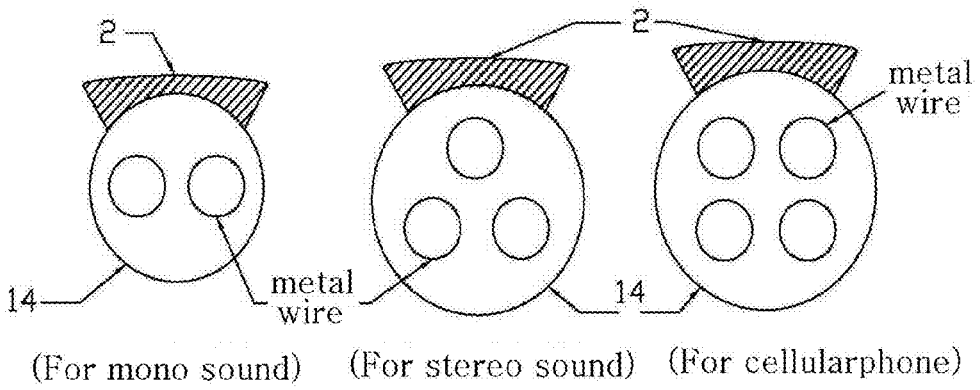
Figure 7E:
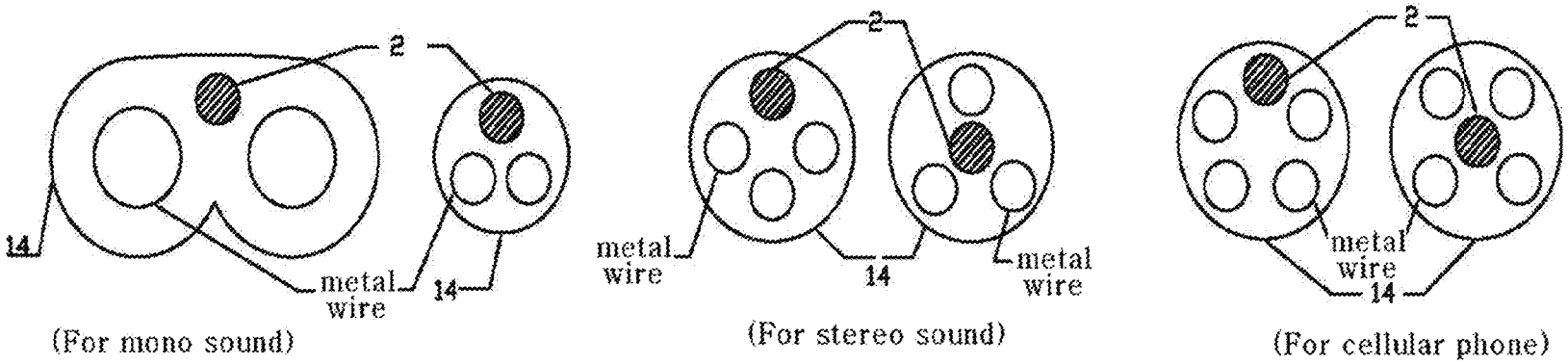

Referring to FIG. 7*c*-7*e*, the single line portion (14) of a conventional earphone wire consists of two metal wires for mono sound, or three metal wires for stereo sound. An earphone for mobile phone has four metal wires due to an additional microphone wire. The single line portion (14) which is coated with plastic polymer usually appears in either one or two strands type regardless the number of the metal wires in the single line portion (14).

In two strands type of the single line portion (14), the tying portion (2) is integrated into the middle of two strands by bonding, and the gap between two strands and the tying portion (2) is filled with adhesive agent to give a tighter bonding. The tying portion (2) is integrated along the circumference of the single line portion (14) in one strand type by adhesive agent.

In another preferred embodiment, referring to FIG. 7*e*, the tying portion (2) is placed on the top or the center of the single line portion (14) and coated or molded with polymer to integrate the tying portion (2) into the single line portion (14).

The integration of the tying portion (2) into the single line portion (14) by polymer coating or molding gives more durable bonding therebetween than by adhesive means so that damages caused by a repeated use, such as being separated from each other or being cut, can be effectively prevented by coating or molding of the tying portion (2) with polymer.

The Second Embodiment of the Present Invention

The second embodiment of the present invention relates to an earphone having a speaker portion (11') worn in both ears; a branch line portion (12') wherein one side thereof is connected to the speaker portion (11'); a single line portion (14') wherein one side thereof is connected to a joint portion wherein the two strands of the branch line portion (12') are collected; a connection portion (15') disposed at the other end of the single line portion (14') to be connected to a terminal of a sound system; and a tying portion (2') formed on the single line portion (14');

wherein the tying portion (2') is made of a plastically deformable polymer or metal or coated metal, and integrated into the single line portion (14'), or a plastically deformable metal wire or coated metal wire and bonded to the single line (14'), and thus is capable of being bent when being applied with an external force and maintains a bending state even if the external force is removed, wherein the tying portion (2') is capable of tying an earphone wire folded or wound in several strands by being forcibly extended by pulling one end thereof, and then being wound around the folded or wound earphone wire, and wherein the tying portion (2') is capable of untying the folded or wound earphone wire by forcibly rotating and unwinding the tying portion (2'), or by pulling one end thereof such that the tying is released in a one-touch way.

Figure 8:
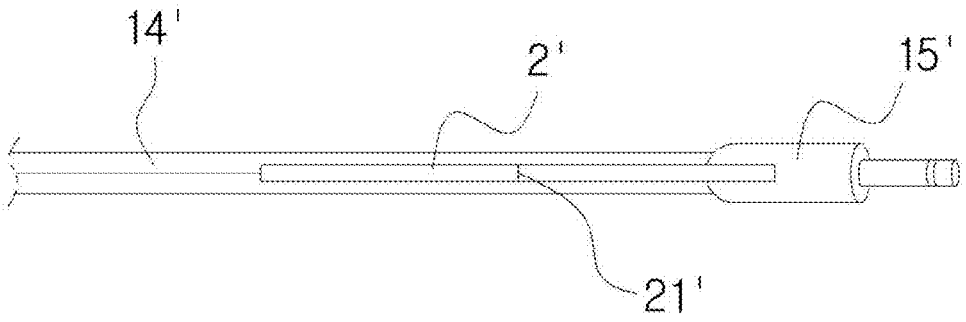
FIG. 8 illustrates a tying portion formed over a joint portion between a single line portion and a connection portion, and a indicator of an earphone according to the second embodiment of the present invention.
Figure 9A:
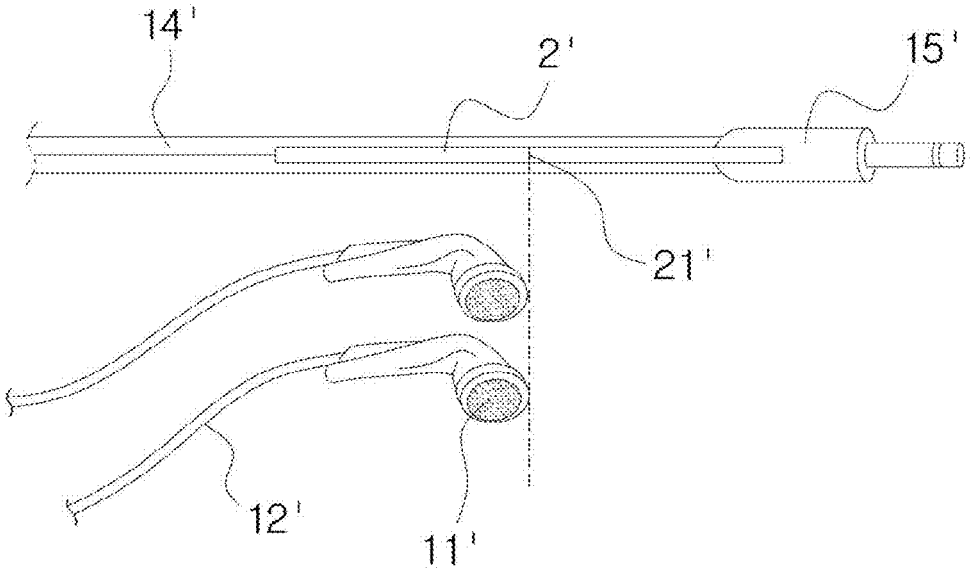
FIGS. 9*a*-9*c* illustrate a tying process of the second embodiment of the present invention.
Figure 9B:
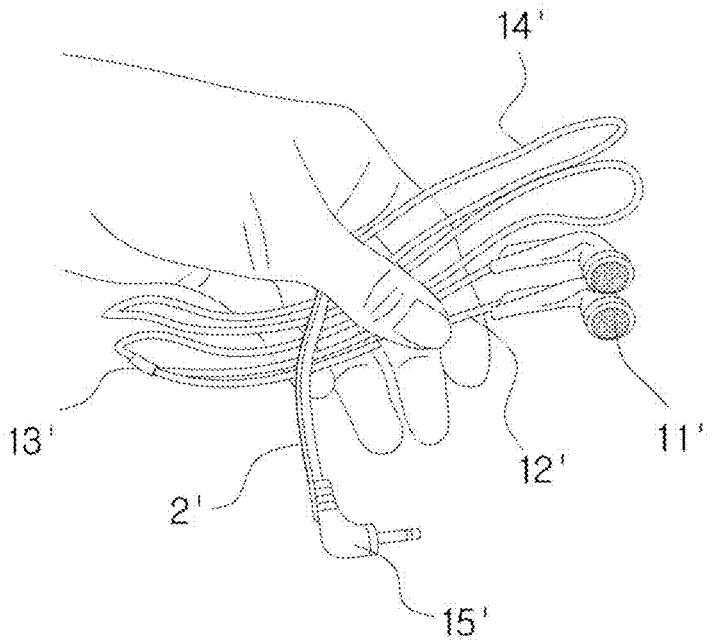
Figure 9C:
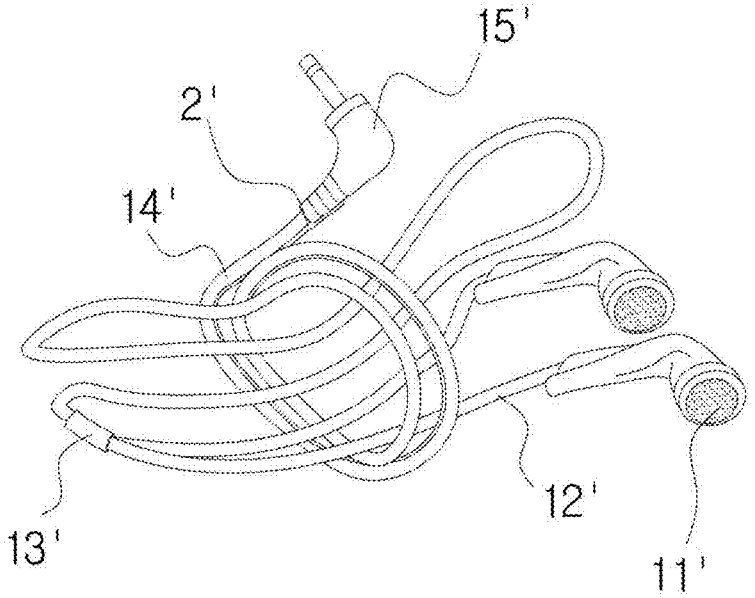

FIGS. 7*a*-7*e* illustrate the single line portion of an earphone according to the second embodiment of the present invention. FIG. 8 illustrates a tying portion formed over a joint portion between the single line portion (14') and the connector portion (15') of an earphone according to the second embodiment of the present invention. FIGS. 9*a*-9*c* illustrate a tying process of the earphone according to the second embodiment of the present invention.

The second embodiment of the present invention is characterized in that the tying portion (2') formed in a straight line with a plastically deformable polymer or metal or coated metal, is capable of being bent when being applied with an external force and maintains a bending state even if the external force is removed. A metal wire coated with polymer can be a preferred example as the plastically deformable tying portion.

The tying portion (2') in the second embodiment is bonded to the single line portion (14') by the same way as the tying portion (2) in the first embodiment. Therefore, in two strands type of the single line portion (14'), the tying portion (2') is bonded to the middle of two strands of the single line portion (14'), and the gap between the single line portion (14') and the tying portion (2') is filled with adhesive agent to give a tighter bonding. Also the bonding of the tying portion (2') is made along the circumference of the single line portion (14') in one strand type as shown in FIGS. 7*c*-7*d*.

In addition, the tying portion (2') is placed on the top of the single line portion (14') and coated or molded with a polymer to integrate the tying portion (2') into the single line portion (14').

The tying portion (2') is formed along the single line portion (14') up to the connection portion (15'), and is capable of being wound around the folded earphone wire.

Referring to FIG. 9*c*, it is preferred that compared to the overall length of the earphone which is usually about 110 cm with 13-15 strands of wire when folded, the tying portion (2') has a length of approximately $1/13$-$1/15$ such that the folded earphone can be wound in approximately 2-6 turns. This is achieved because the winding can be easily released if the tying portion is wound by a single turn, and there may be any unnecessary winding operation if the tying portion is wound by more 6 turns.

Further, the tying portion (2') in the single line portion (14') is extended up to the connection portion (15') as illustrated in FIG. 8, so that the joint portion therebetween is prevented from being bent by an external force during the use of the earphone and further being damaged and cut due to a repeated use thereof.

As illustrated in FIG. 8, an indicator (21') can be further constructed in the center of the tying portion (2') as a marker for aligning the earphone wire. Referring FIGS. 9*a-c*, the end of the speaker portion is aligned to the indicator (21') and the aligned earphone wire is longitudinally folded in several times to have an appropriate length. Then, the tying portion (2') is wound around the middle of the folded earphone wire.

As illustrated in FIG. 9*c*, one side of the single line portion (14') is grasped and wound by 2-6 turns around the folded wire, resulting in a compactly organized earphone.

Further, the indicator (21') can be constructed in the form of the protrusion or the dent on the surface of the tying portion (2'), or colored for the enhanced visualization.

The Third Embodiment of the Present Invention

The third embodiment of the present invention is the same as the first embodiment except that a tying portion (2") of the third embodiment is in the form of a helically coiled hollow tube and thus capable of sliding along a single line portion (14'") through a hole (22").

Figure 10:
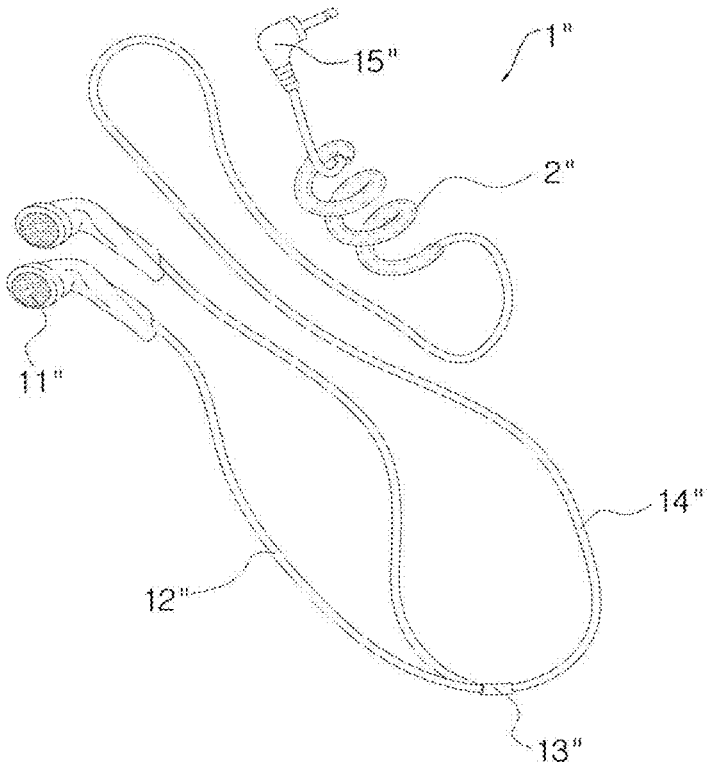
FIG. 10 illustrates an earphone according to the third embodiment of the present invention.
Figure 11:
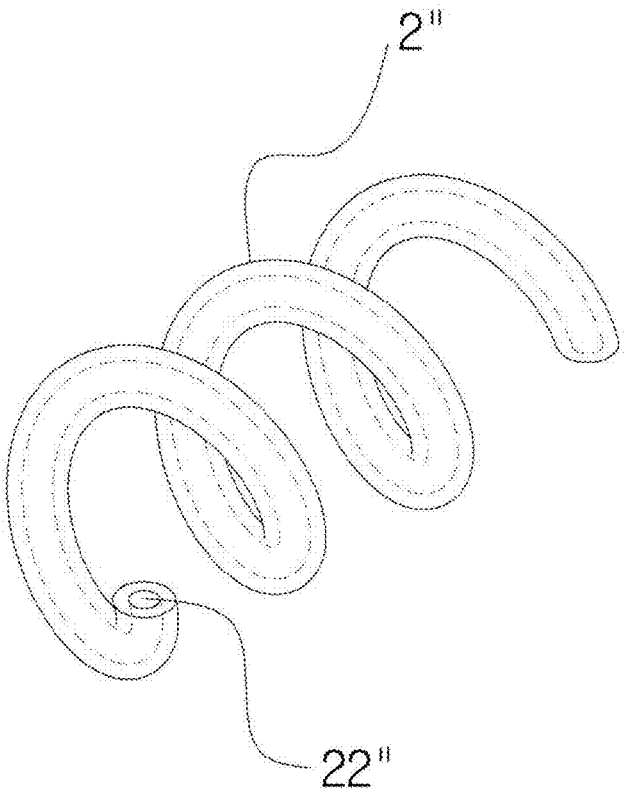
FIG. 11 illustrates a tying portion of an earphone according to the third embodiment of the present invention.
Figure 12:
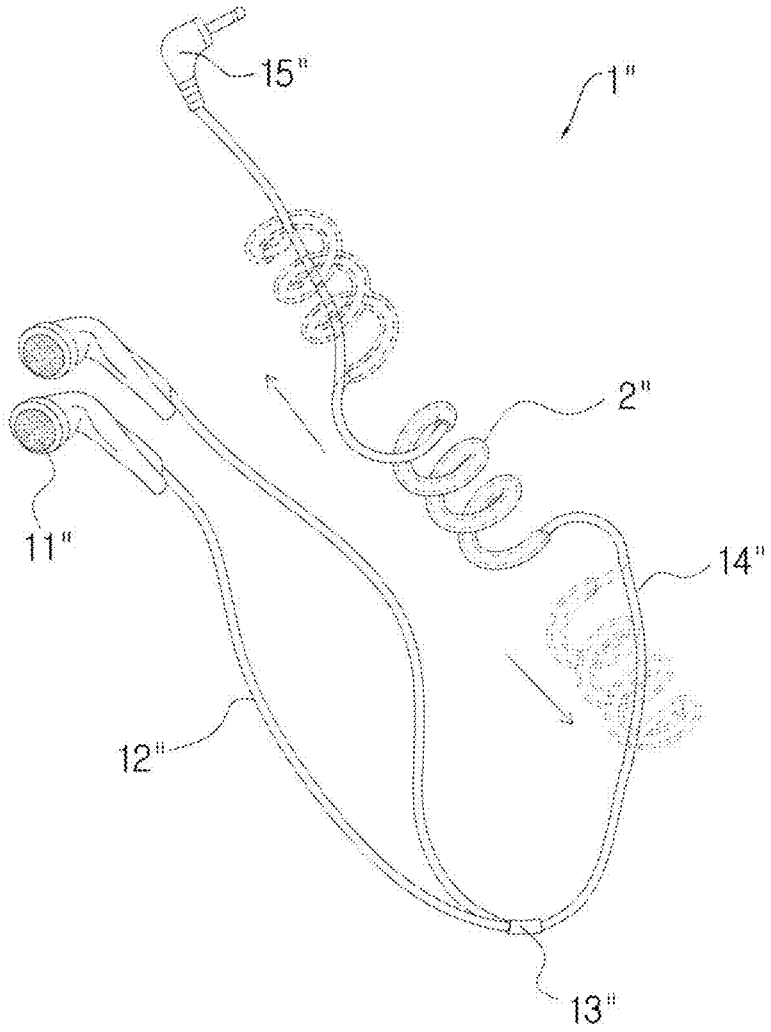
FIG. 12 illustrates a view of a tying portion capable of sliding along the single line portion of an earphone according to the third embodiment of the present invention.
Figure 13:
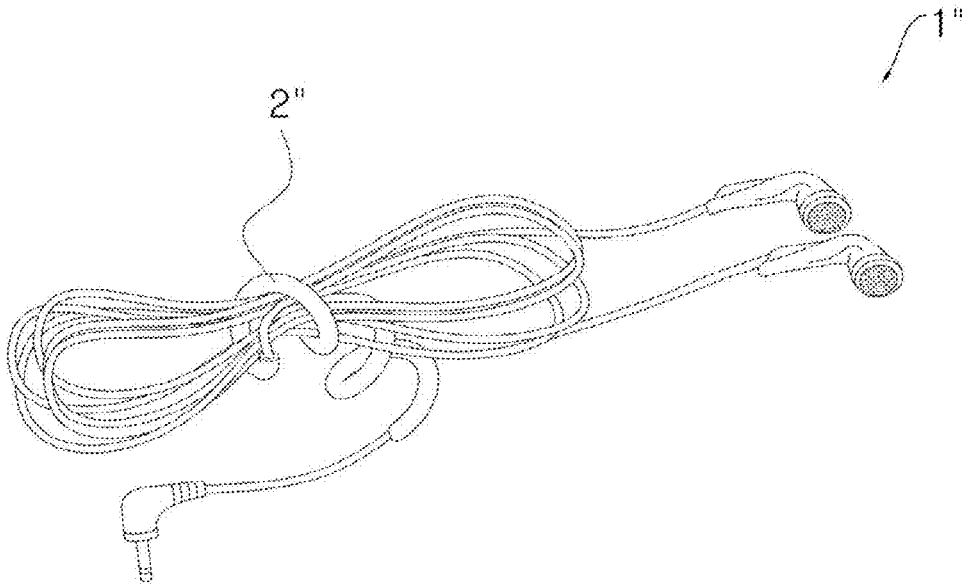
FIGS. 13-14 illustrate a tying process of the third embodiment of the present invention.
Figure 14:
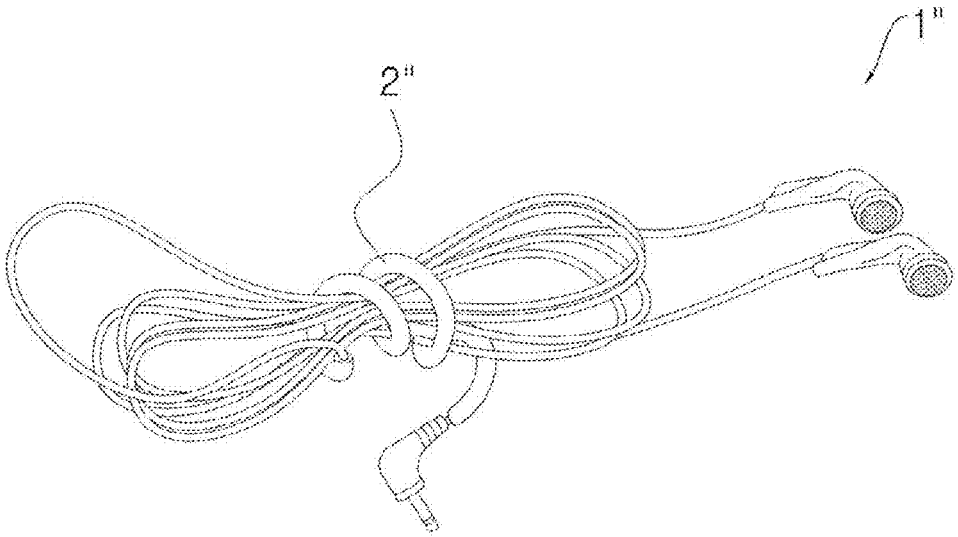

FIG. 10 illustrates an earphone according to the third embodiment of the present invention. FIG. 11 illustrates a tying portion of the third embodiment of the present invention. FIG. 12 illustrates a view of a tying portion capable of sliding along the single line portion of an earphone according to the third embodiment of the present invention. FIGS. 13-14 illustrate a tying process of the third embodiment of the present invention.

The third embodiment of the present invention is characterized in that the tying portion (2") which is constructed into a helically coiled hollow tube into which the single line portion (14") is inserted.

The tying portion (2") made of an elastic material, such as an elastic metal coil or polymer or polymer embedded with metal, is able to provide the earphone easily facilitating a tying and untying of the folded earphone wire due to its restitution force. The helically coiled hollow tube configuration wherein the single line portion (14") is positioned in the interior of the tying portion, prevents disengagement of the tying portion (2") therefrom.

The tying portion (2") in the third embodiment of the present invention is positioned on one side of the single line portion (14") and has a hole on the inner side thereof such that the tying portion (2") slides along the single line portion (14"), and when the earphone which normally has a length of roughly 110 cm is folded to form approximately 13-15 strands of wire, the winding is enabled by rotating the tying portion (2") by 2-6 turns;

A coupling process of the tying portion (2") to the earphone (1") is as follows: a cutting line (not shown in Figs) is formed by cutting longitudinally along the length of the tying portion (2"), opposite cutting ends are spread out enough to insert the single line portion (14") into the interior of the tying portion (2"), and then the cut line is sealed with adhesive agent to prevent disengagement of the tying portion (2") from the single line portion (14").

It is obvious to a person skilled in the art that the tying portion (2") can be made of a stretchable polymer wherein the cutting line is not necessary, and the single line portion (14") can be inserted into the tying portion (2") during or after a process of manufacturing the earphone.

Since constructed in the form of the helically coiled spring with elastic polymer, the tying portion (2") can be wound around the folded wire, or by the same way as in the first embodiment.

Referring to FIG. 12, the tying portion (2") of the third embodiment is not necessary to have the indicator (21') since the location of the tying portion (2") of the third embodiment is adjustable along the single line portion (14").

For example, when the connection portion (15") is spaced from the tying portion (2") at certain intervals, the tying portion (2") is extended and unfolded by pulling one side thereof and wound around the middle of the folded wire. As illustrated in FIG. 13, the connection portion (15") spaced from the tying portion (2") at certain intervals tends to droop without being fixed to one side of the tying portion (2"). The single line portion (14") which is located at the position symmetrical to the connection portion (15") around the tying portion (2") is pulled in a manner such that the connection portion (15") gets closer to the tying portion (2"), as illustrated in FIG. 14. Hence, even if the tying portion (2") slides along the single line portion (14") and is positioned near a stopper (13") or to the connection portion (15"), the single line portion (14") positioned on one side of the tying portion (2") by penetrating the tying portion (2") can be pulled such that the tying portion (2") is positioned roughly in the center part of the earphone wire.

Therefore, when positioned close to the stopper (13") or the connection portion (15") after tying, the tying portion (2") is capable of being located around the middle of the folded earphone wire by pulling either part of the single line portion (14") close to one side of the tying portion (2'").

The Forth Embodiment of the Present Invention

The forth embodiment of the present invention is the same as the second embodiment except that a tying portion (2'") of the forth embodiment is in the form of a hollow tube and thus capable of sliding along a single line portion (14'") through a hole.

Figure 15:
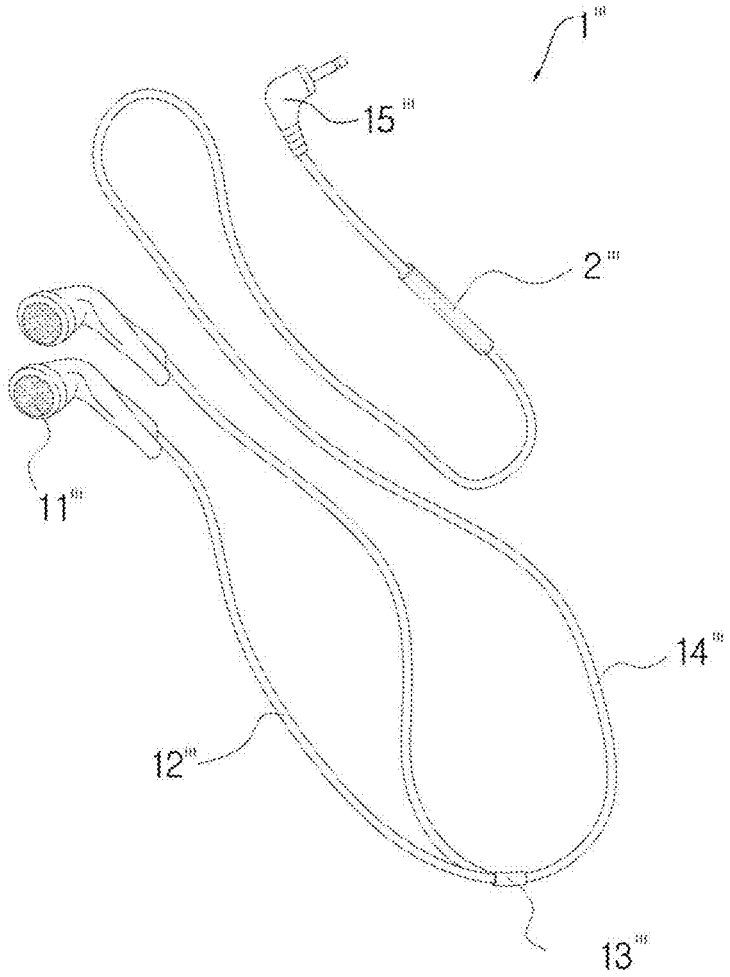
FIG. 15 illustrates an earphone according to the forth embodiment of the present invention.
Figure 16:
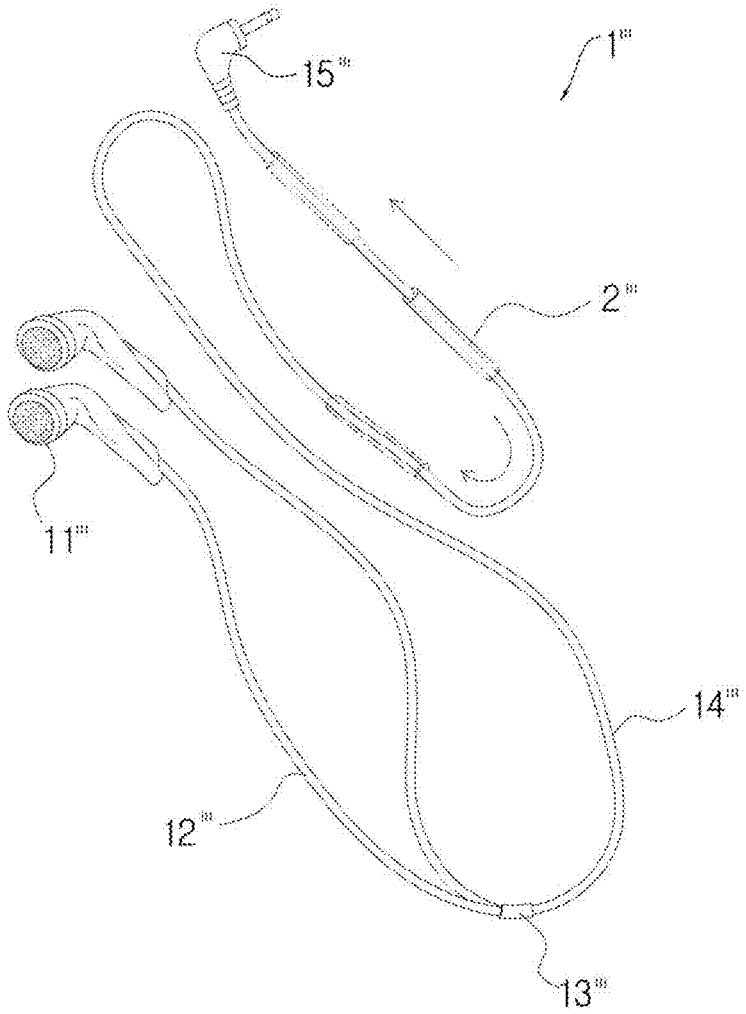
FIG. 16 illustrates a view of a tying portion capable of sliding along the single line portion of an earphone according to the forth embodiment of the present invention.
Figure 17:
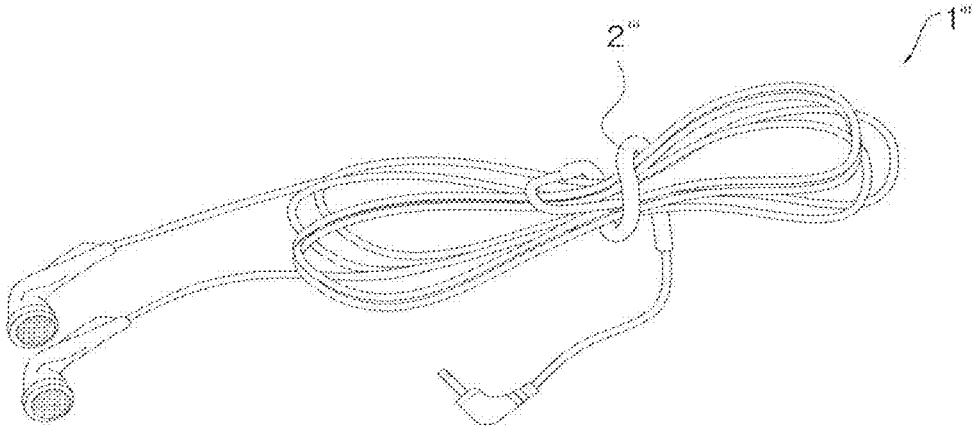
FIGS. 17-18 illustrate a tying process of an earphone according to the forth embodiment of the present invention.
Figure 18:
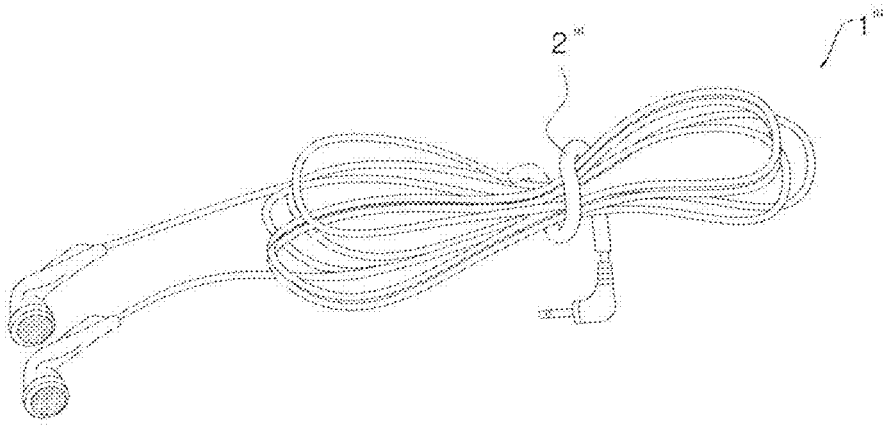
Figure 19:
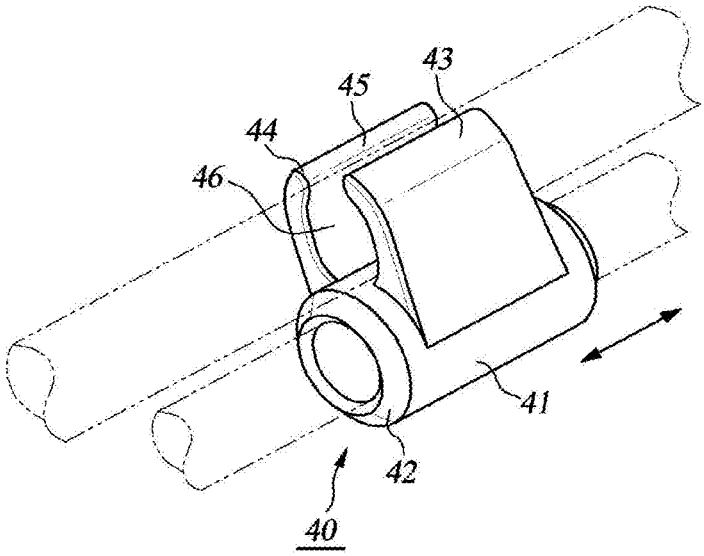
FIG.19 PRIOR ART
FIG. 19 illustrates a prior art of an earphone with a tying attachment.

FIG. 15 illustrates an earphone according to the forth embodiment of the present invention. FIG. 16 illustrates a view of a tying portion capable of sliding along the single line portion of an earphone according to the forth embodiment of the present invention. FIGS. 17-18 illustrate a tying process of an earphone according to the forth embodiment of the present invention.

The forth embodiment of the present invention is characterized in that the tying portion (2'") is formed into a straight hollow tube, and made of a plastically deformable polymer or metal or coated metal. Therefore, the tying portion (2'") of the forth embodiment is capable of being bent when being applied with an external force and maintaining a bending state even if the external force is removed.

When the tying portion (2'") is made of a metal, it is more likely to be broken or damaged due to a repeated bending. Therefore, the tying portion (2'") positioned on one side of the single line portion (14'") are combined by coating or molding on the outer side using a polymer material in order for the single line portion (14''') and the tying portion (2''') to be integrated to each other.

In addition, it would be obvious that if the tying portion (2'''), which is extended and unfolded in a straight line by applying an external force, and the folded earphone wire are wound together closely to a right angle, the winding is close to one turn of the tying portion (2'''), and if the tying portion (2''') is wound in parallel to the earphone wire, all of the turns (e.g. six turns) of the tying portion (2''') are applied such that the winding is performed in a tighter manner.

Since the tying portion (2''') is capable of sliding through the hole along the single line portion (14'''), the diameter of the hole is larger than that of the single line portion (14'''). In addition, a cutting line (not shown in Figs) is formed by cutting longitudinally along the length of the tying portion (2'''), and opposite cutting ends are spread out so that the single line portion (14''') is inserted into the interior of the tying portion (14'''). The cutting line is then sealed with adhesive agent to prevent disengagement of the tying portion (2''') from the single line portion (14''').

The tying process of the tying portion (2''') formed in the shape of the hollow tube is that the user tightly holds one side of the tying portion (2''') and then winds the other end of the tying portion (2''') by 2-6 turns around the folded earphone wire as illustrated in FIG. 17.

When the connection portion (15''') is spaced from the tying portion (2''') at certain intervals tends to droop without being fixed to one side of the tying portion (2''') as shown in FIG. 18, the single line portion (14'') which is formed at the position symmetrical to the connection portion (15''') around the tying portion (2''') is pulled such that the tying portion (2''') is positioned roughly in the center part of the earphone wire to prevent the earphone wire from being entangled by the connection portion (15'').

The Fifth Embodiment of the Present Invention

The fifth embodiment of the present invention relates to a wire installed with a tying attachment comprising: a body part (71) embodied with a penetration hole (71*a*) through which an earphone wire is inserted; and a fixing part (73) formed into a flat spiral spring shape is extensible and integrally connected to the lateral side of the body (71).

The body part (71) enables to slide along the longitudinal direction of the earphone wire through the penetration hole (71*a*).

The flat spiral spring shape fixing part (73) has at least a single turn over the body part (71), and can be extensible from the body part (71) by stretching the end of the fixing part (73).

The flat spiral spring shape fixing part (73) has an inside and outside surface, and a bending portion (731) is formed by inwardly bending the distal of the fixing part (73) so that the bending portion (731) remains in contacts with the outer surface of the fixing part (73).

Figure 20:
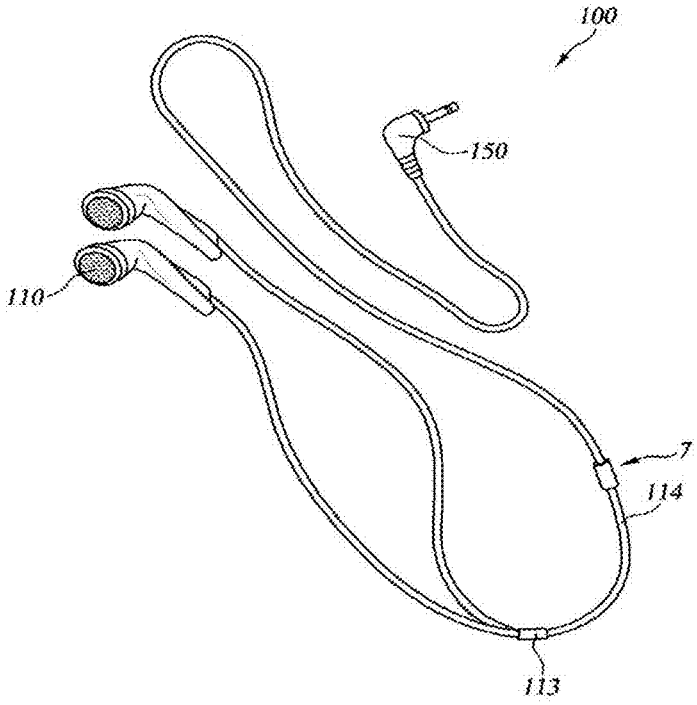
FIG. 20 illustrates an earphone with a tying attachment according to the fifth embodiment of the present invention.

FIG. 20 illustrates an earphone (100) according to the fifth embodiment of the present invention comprising: a speaker (110); a connection portion (150); a wire (114); a bifurcation portion (113); and a tying attachment (7).

The speaker portion (110) is worn on the user's both ears and delivers audio sound to the user.

The connection portion (150) is electrically connected to a terminal of audio system.

The wire (114) has a round shape cross-section and a length, and each end of the wire are connected to the speaker portion (110) and the connection portion (150), respectively.

The bifurcation portion (113) splits a wire (114) which extends from the connection portion (150) toward the speaker portion (110), into two strands connecting to a pair of the speaker portion (110).

The tying attachment (7) is attached to the earphone wire (114) which is inserted into the penetration hole (71*a*) of the body part (71) while the earphone is in use. When the earphone is not in use, the tying attachment (7) enables to tie the folded earphone wire (114).

Figure 21:
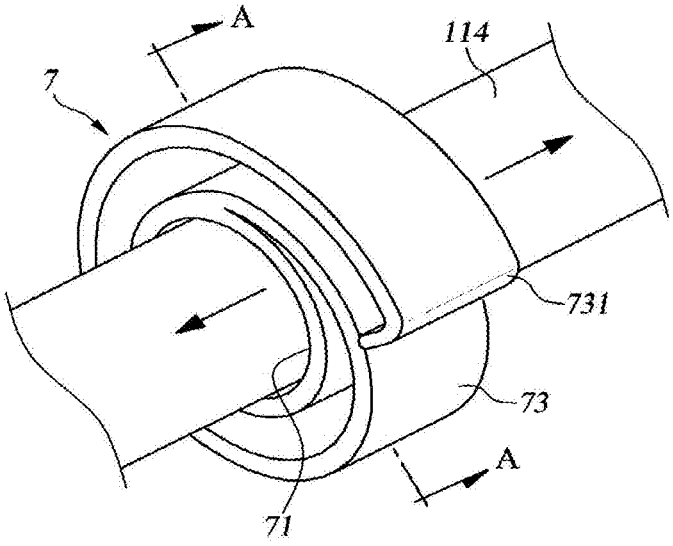
FIG. 21 illustrates an enlarged view of a tying attachment shown in FIG. 20.
Figure 22:
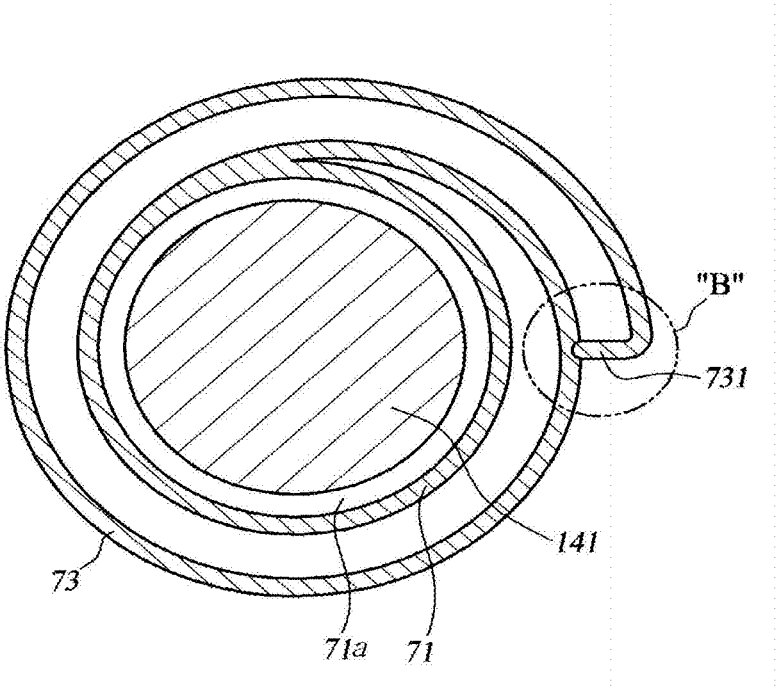
FIG. 22 illustrates a cross sectional view of a tying attachment along the A-A line shown in FIG. 21.
Figure 23:
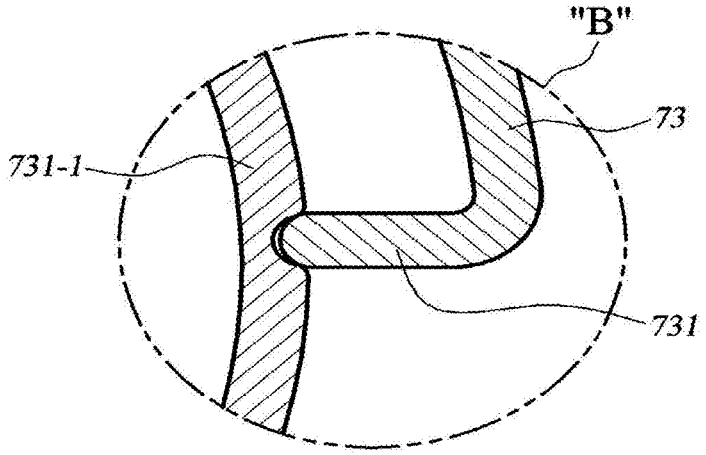
FIG. 23 illustrates an enlarged view of "B" shown in FIG. 22.

FIG. 21 illustrates an enlarged tying attachment of the fifth embodiment of the present invention. FIG. 22 illustrates a cross sectional view of a tying attachment along the A-A line shown in FIG. 21. FIG. 23 illustrates an enlarged view of "B" shown in FIG. 22.

Referring to FIGS. 21-23, the tying attachment (7) comprises the body part (71) and the fixing part (73).

The body part (71) is embodied with the penetration hole (71*a*) through which the wire (114) is inserted. The penetration hole (71*a*) in the body part (71) has a circular cross section corresponding to the shape of the wire, and the outer side of the body part (71) is also formed in a circular cross section, without a circular shape being required. However, it is preferred to have the circular cross section in order to minimize the volume of the fixing part when the fixing part, as mentioned later, is rolled.

The fixing part (73) is formed into the flat spiral spring shape having a thin plate cross section like a belt, and is integrally connected to the lateral side of the body part (71). The fixing part (73) is made of an elastic polymer or metal or rubber or other materials having elasticity, and the fixing part (73) and the body part (71) can be made of the same material.

Figure 24:
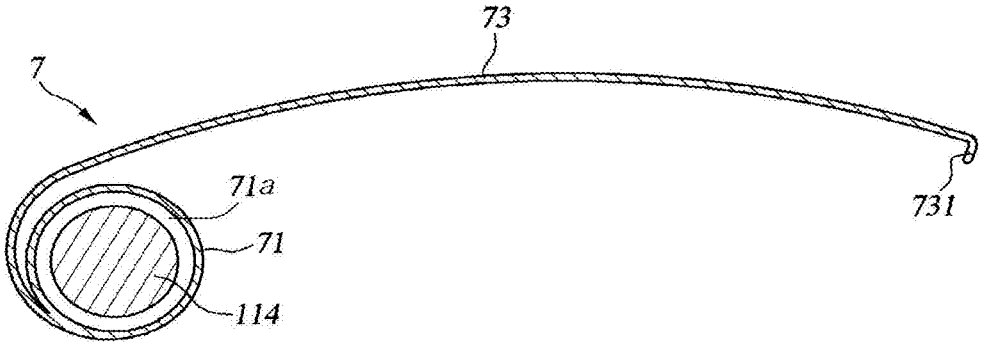
FIG. 24 illustrates a view of an extended form of a tying attachment according to the fifth embodiment of the present invention.
Figure 25:
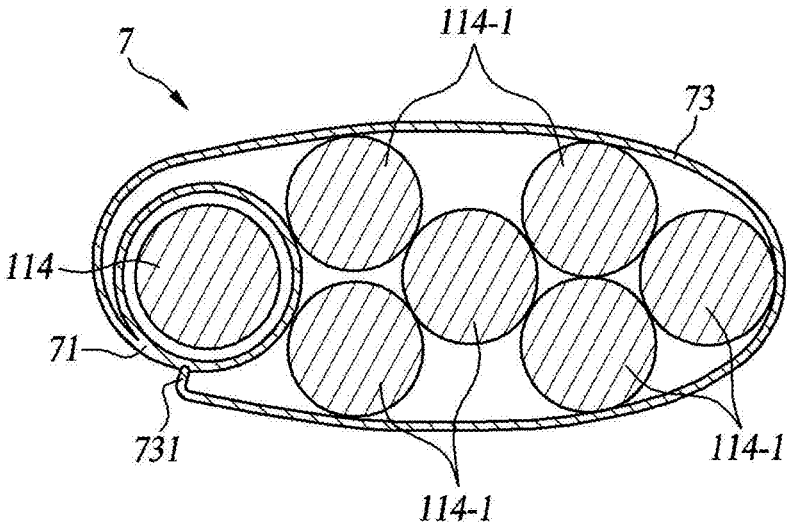
FIG. 25 illustrates a cross sectional view of a tying attachment wound around the folded earphone wire with multiple strands.
Figure 26:
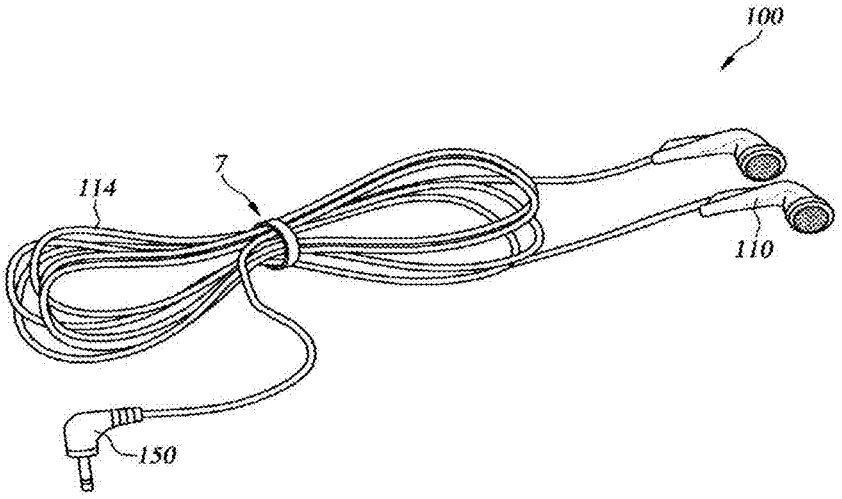
FIG. 26 illustrates an earphone wound with a tying attachment according to the fifth embodiment of the present invention.

FIG. 24 illustrates a view of an extended form of a tying attachment according to the fifth embodiment of the present invention. FIG. 25 illustrates a cross sectional view of a tying attachment wound around the folded earphone wire. FIG. 26 illustrates an earphone wound with a tying attachment according to the fifth embodiment of the present invention.

Referring to FIGS. 24-26, the fixing part (73) is wound around the folded wire (114) having multiple strands of wire. The fixing part (73) remains coiled along the circumference of the body part (71) when it is not in use. Referring to FIG. 24, the fixing part (7) can be extended from the body part (71) by pulling the fixing part (73) outwardly, and then wound around the folded wire (114).

The fixing part (73) is coiled around the body part (71), and is uncoiled from the body part (71) by pulling the distal end of the fixing part (73).

Referring to FIG. 25, releasing the folded wire (114) can be easily completed by pulling the distal end of the fixing part (73).

FIG. 26 illustrates another modification of the tying attachment (7). The fixing part (73) is fully extended until the body part (71) is open, and then the folded earphone wire (114) having multiple strands of wire can be placed in the interior of the body part (71). By releasing the fixing part (73), the tying attachment is elastically restored to the original spiral spring shape to hold the earphone wire.

Referring to FIG. 23, the fixing part (73) is extended from the body part (71) and is wound by at least a single turn by forming a spiral curve such that the spiral angle formed by both ends of the fixing part (73) forming the spiral curve is greater than 360°.

If the fixing part (73) is long in length with a large number of windings, it is possible to wind the earphone wire (114) having several strands of wire. Moreover, the volume of the tying part of the folded earphone wire can be reduced by being lengthily folded and thus the fixing part (73) having a relatively short length with a small number of windings is capable of tying the folded earphone wire. However, it is impossible to wind the earphone wire (114) having multiple strands of wire. Therefore, the length of the fixing part (73) (i.e. the number of turns in the flat spiral spring configuration of the fixing part (73)), is carefully determined in consideration of the overall length of the earphone wire (114).

The wire (114) is inserted into the penetration hole of the body part (71) and thus the body part (71) is capable of sliding along the wire (114).

The sliding range of the body part (71) along the earphone wire (114) can be from the connection portion (150) to the speaker portion (110), or from the connection portion (150) to the bifurcation portion (113). Therefore, the tying attachment (7) is conveniently engaged in tying the earphone wire (114) at any position in the earphone wire (114).

The fixing part (73) comprises the bending portion (731) which is constructed by inwardly bending the distal end of the fixing part (73).

The bending portion (731) plays a role as a stopper to prevent the fixing part (71) from being unintentionally released from the body part (73) while the tying attachment (7) is in use or not.

The bending portion (731) is in position to be compressively pressed on the outer surface of the fixing part (73). Therefore, the fixing part (73) is preferably made of soft material for the tight binding.

Although a flat spiral surface of the fixing part (73) is described to be pressed and recessed inwardly by an end of the bending portion (731) according to FIGS. 23-24, it is not limited such that the amount of pressure for bending inwards the surface is necessarily applicable.

Effect of the Invention

The present invention is to provide an earphone comprising a tying portion on one side of a single line portion to organize the entire earphone wire without an additional fixing device. The earphone wire can be easily wound and folded into a bundle using a hand as a reel, and the folded or wound earphone wire bundle can be simply tied by winding the tying portion around the folded earphone wire bundle.

Therefore, the folded earphone wire is kept tidy and untangled when not in use, and releasing the folded earphone wire can be easily completed by pulling one side of the tying portion, instead of unwinding the tying portion in the opposite direction.

In addition, meanwhile a conventional helically coiled telephone cord is forcibly stretched while in use and thus subject to a continuous tension in the longitudinal direction of the cord, resulting in losing the elasticity of the cord over long-term use, the tying portion of the present invention is subject to the minimum and temporary tension while tying the folded or wound earphone wire.

Further, since a joint portion between the single line portion and the connection portion, is usually tend to be bent while the user uses an earphone of a mobile phone or an audio device which is placed in a pocket or a bag, the joint portion would be damaged or cut due to the repeated bending thereof. Therefore, it is possible to prevent the joint portion from being damaged or cut by positioning the tying portion over the joint portion.

Further, when formed into a hollow tube, the tying portion is capable of sliding along the single line portion. After the folded or wound earphone wire is tied with the tying portion, the tying portion is capable of being positioned roughly in the center part of the earphone wire by pulling the single line portion located near one side of the tying portion.

The tying portion made of an elastic material and embedded into the single line portion, is capable of prevent from being disengaged from the single line portion. The tying portion made of a plastically deformable material and formed into a straight line, is capable of being wound into the form of helical coil shape around the folded or wound earphone wire. Additionally, coloring or adding design patterns for the tying portion can visually differentiate from the single line portion.

In addition, the present invention effectively provides an earphone easily facilitating the tying and untying of an earphone wire having a reduced volume which provides portability and convenience to a user.

It is obvious to a person skilled in the art that the technical features of the present invention can be applicable to the power cords, USB wires, transmitting wires and other devices wires.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An earphone comprising:

a speaker portion worn in both ears;

a branch line portion having one side connected to the speaker portion;

a joint part in which at least two branch lines are joined;

a single line portion having one side connected to the joint part, the branch line portion and the single line portion collectively forming an earphone wire;

a connection portion disposed at the other side of the single line portion to be connected to a terminal of a sound system; and a tying portion for wrapping the earphone wire in a folded status, the tying portion having a hollow tube shape and an elastic helical coil spring shape, surrounding a part of outer surface of the single line portion and slidable along the single line portion, wherein the tying portion maintains the elastic helical coil spring shape both when the earphone wire in the folded status is wrapped around by the tying portion and when the earphone wire in the folded status is not wrapped around by the tying portion.

2. The earphone according to claim 1, wherein the tying portion has a length capable of being wound by 2-6 turns around the folded earphone wire.

3. The earphone according to claim 1, wherein the tying portion is made of an elastic synthetic resin, metal or coated metal.

* * * * *